United States Patent [19]

Houle

[11] 4,303,020

[45] Dec. 1, 1981

[54] REINFORCED FIBERBOARD PALLET

[76] Inventor: Rene C. Houle, 11 Salem Dr., North Providence, R.I. 02904

[21] Appl. No.: 48,766

[22] Filed: Jun. 14, 1979

[51] Int. Cl.[3] ..... B65D 19/34

[52] U.S. Cl. ..... 108/51.3

[58] Field of Search ..... 108/51.3, 51.1, 53.1, 108/53.3, 56.1, 56.3, 57.1, 901, 902; 206/386, 598, 599, 600; 248/174, 152

[56] References Cited

U.S. PATENT DOCUMENTS

| | | | |
|---|---|---|---|
| 2,444,183 | 6/1948 | Cahners | 108/51.3 |
| 2,904,297 | 9/1959 | Hamilton | 108/56.3 X |
| 2,958,494 | 11/1960 | Lovegreen | 108/51.3 |
| 3,434,435 | 3/1969 | Achermann et al. | 108/51.3 |
| 3,519,190 | 7/1970 | Achermann et al. | 108/51.3 X |
| 4,169,417 | 10/1979 | Gemvik | 108/56.3 |

FOREIGN PATENT DOCUMENTS

| | | | |
|---|---|---|---|
| 752210 | 2/1967 | Canada | 108/51.3 |

*Primary Examiner*—William E. Lyddane

*Attorney, Agent, or Firm*—William Frederick Werner

[57] ABSTRACT

A pallet having a platform held in suspension between opposite side supports and provided with opposite end stiffening element spreaders.

4 Claims, 17 Drawing Figures

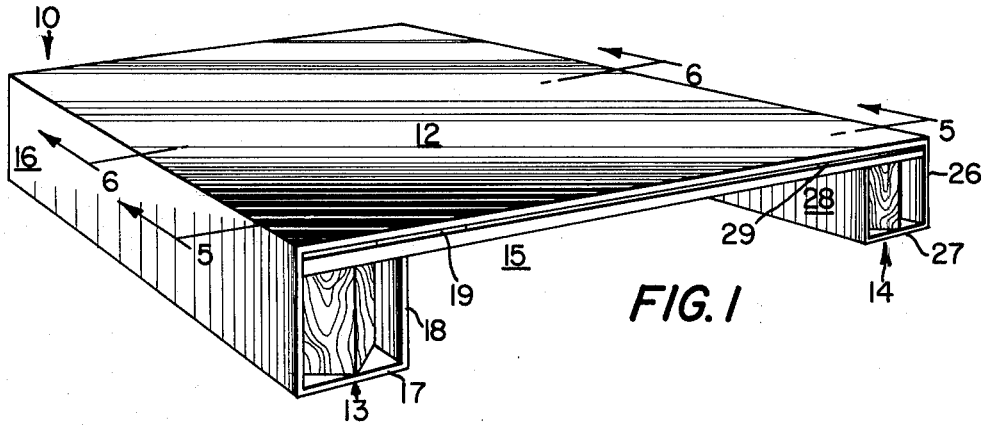
FIG. 1
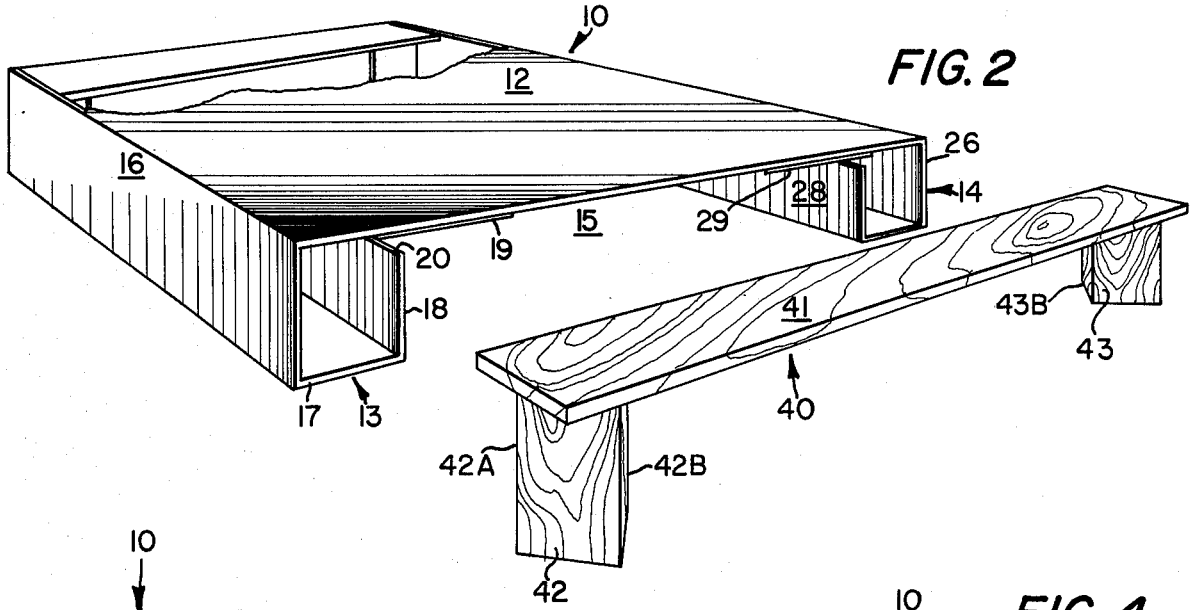
FIG. 2
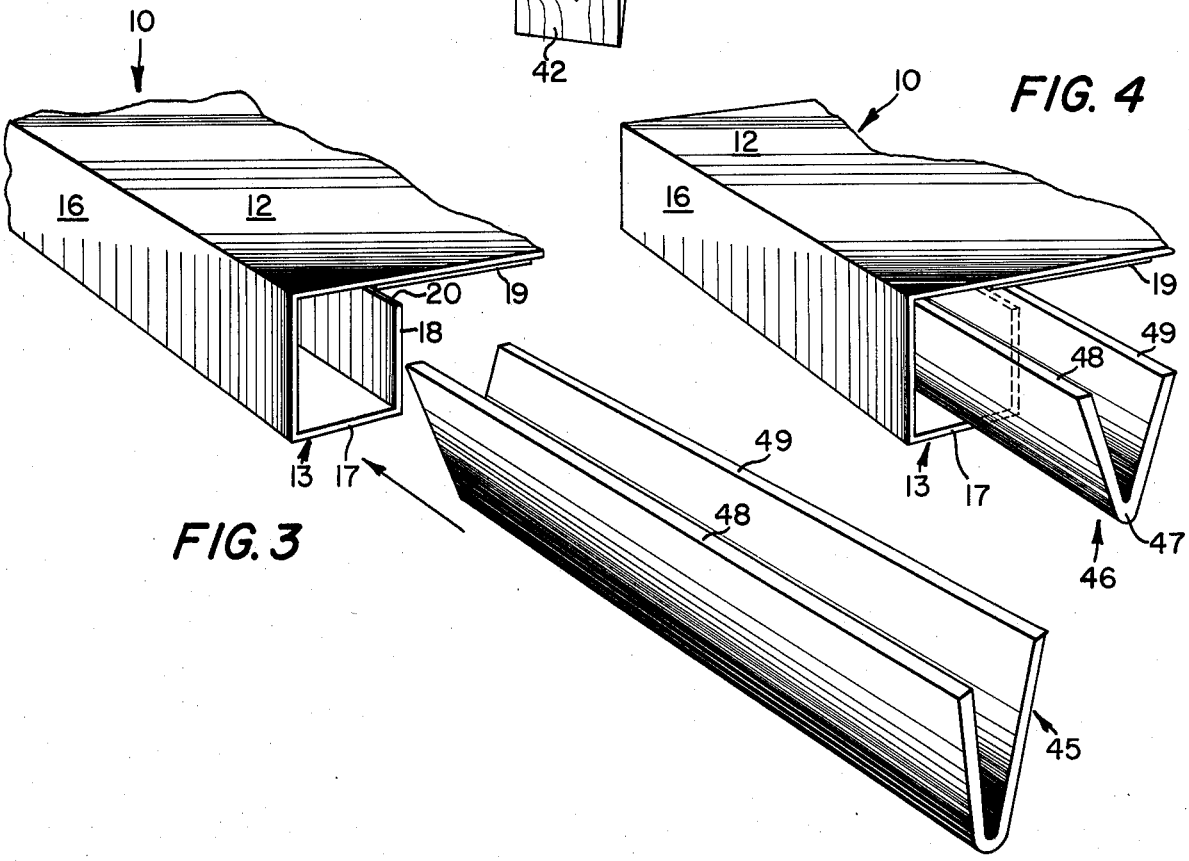
FIG. 3
FIG. 4

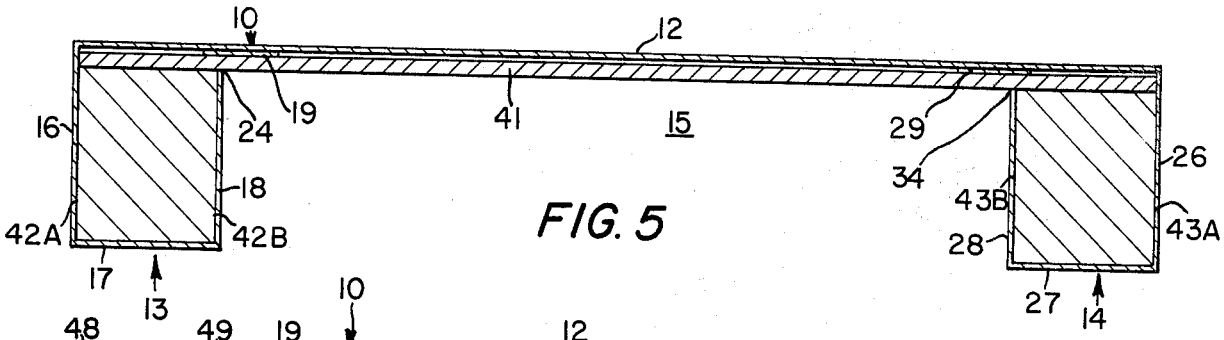
FIG. 5
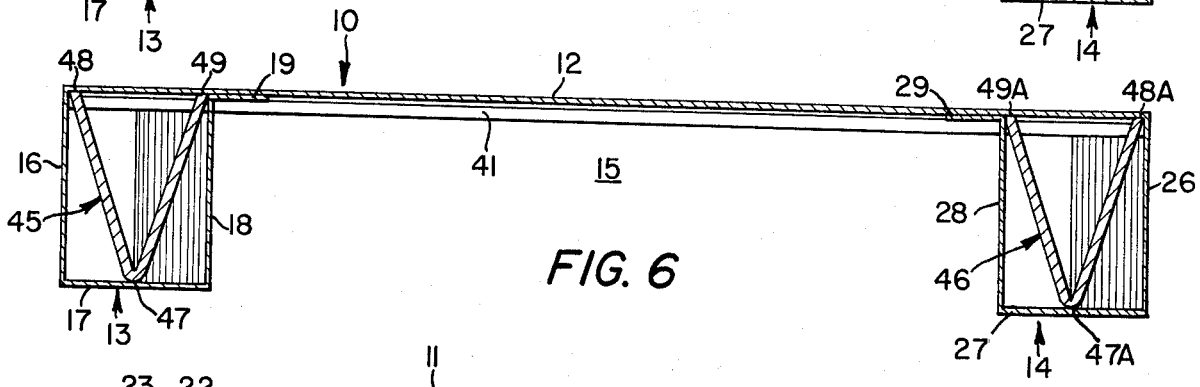
FIG. 6
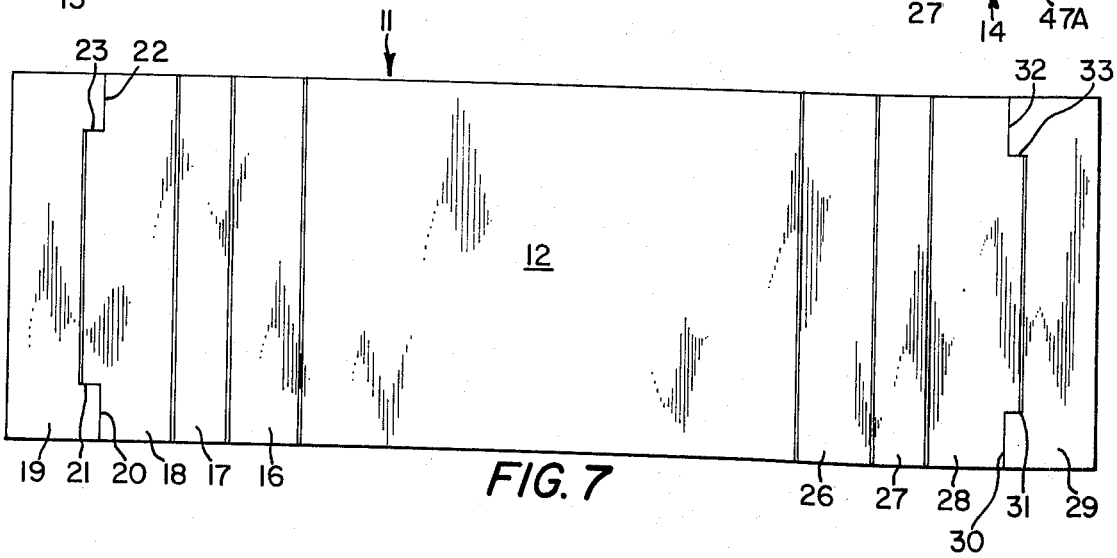
FIG. 7
FIG. 8
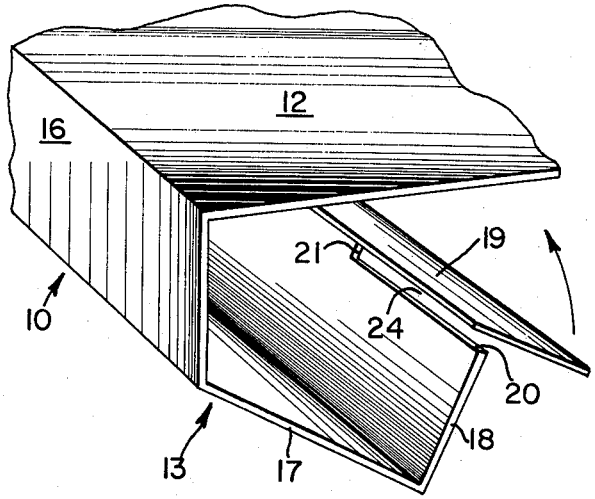
FIG. 9
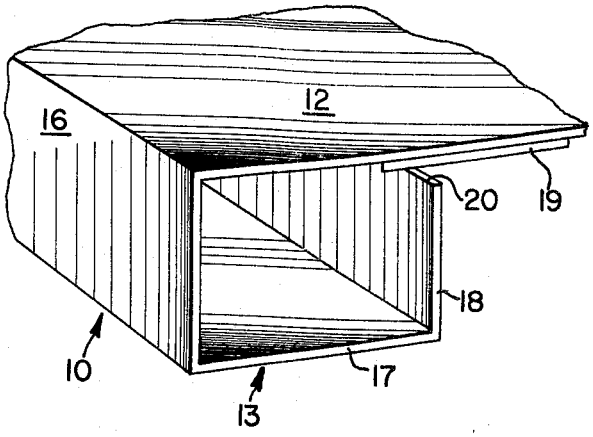

REINFORCED FIBERBOARD PALLET

STATEMENT OF INVENTION

This invention relates to pallets and more particularly to a platform held in suspension to stiffen the platform and thereby add strength thereto; and to provide opposite end stiffening element spreaders.

PRIOR ART

This invention is an improvement over U.S. Pat. Nos. 3,131,656 dated May 5, 1964 and 2,444,183 dated June 29, 1948 and generally relates to portable material support platforms commonly called pallets or skids and adapted for use with fork lift trucks.

Pallets have found use in the storage and transportation of goods. The savings in labor handling is considerable where goods are palletized and shipped through with the pallet to their destination. A drawback to their use in through transportation is that the pallets are carried by common carriers at Interstate Commerce Commission rates for the palletized commodity, just as any shipping package or crate. The pallet therefore contributes a considerable part of the shipping cost because of its weight and, in carload lots, involves expensive space consumption. The above cited two references eliminated wood and steel pallets and replaced them with folded heavy corrugated fiber board.

OBJECTS OF THE INVENTION

It is a primary object of this invention to provide portable pallets or platforms which are light in weight so that their transportation cost will be practically negligible.

It is another object of this invention to provide highly inexpensive platforms having greater strength than heretofore at a small cost which will justify one-shipment use.

It is a further object of this invention to provide platforms which can be supplied in knock-down form for ready assembly by the user or dis-assembled for return shipment.

It is still a further object of this invention to provide lightweight platforms made of fiber-board having adequate strength to handle above average loads.

And a further object of this invention is to provide a platform in suspension, in the nature of a bridge, whereby a platform of lightweight corrugated material is strengthened to support an otherwise unsupportable load.

Other objects of the present invention will become apparent in part and be pointed out in part in the following specification and claims.

BRIEF DESCRIPTION OF THE DRAWINGS

Referring to the drawings in which similar reference characters refer to the same parts:

FIG. 1 is a perspective view of one embodiment of a pallet construction in accordance with this invention;

FIG. 2 is an exploded perspective view of the two component parts constituting the FIG. 1 embodiment, with a section broken away to show the inner construction;

FIG. 3 is an exploded fragmentary perspective of a modified form of a reinforcing member;

FIG. 4 is similar to FIG. 3 showing the reinforcing member in partial working position;

FIG. 5 is a cross sectional view taken on line 5—5 of FIG. 1;

FIG. 6 is a cross sectional view taken on line 6—6 of FIG. 1;

FIG. 7 is a plan view of the body of the pallet, showing the score lines before cutting and folding;

FIG. 8 is a fragmentary perspective view showing the initial folds made to the body;

FIG. 9 is a fragmentary perspective view showing the completed fold in one corner of the body;

DESCRIPTION OF THE PREFERRED EMBODIMENTS

Figure 10:
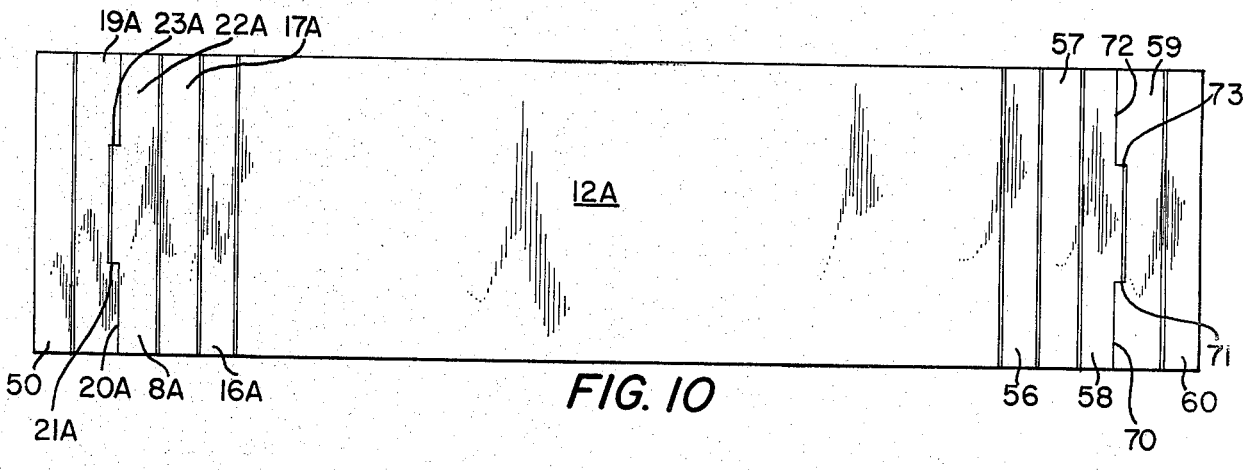
FIG. 10 is a plan view of the body of a modified form of pallet construction showing score lines before cutting and folding.

In proceeding with this invention, reference is made to the drawings, wherein is illustrated the new and improved pallet construction.

With particular reference to all the Figures, the structures shown comprise a pallet 10, or portable materials handling accessory adapted for use in lift truck operations, constructed essentially from a single sheet of fiberboard.

The structure shown in FIGS. 1, 2, 7, 8, 9 and especially FIG. 7, comprises a central panel 12, adapted to form the elevated platform of the device, and having lateral extensions which are suitably scored to permit them to be folded under the platform 12 to provide two oppositely located sleeves 13, 14 extending in parallel relation longitudinally of the structure and defining therebetween a passageway 15 for lift truck fork entry.

Central panel 12 is provided on each side with a lateral extension. The lateral extension on one side is divided by scores into a side panel 16, a bottom face panel 17, an inner upright portion 18 and an under panel 19, for forming sleeve 13. A cut is made along the boundary between inner upright portion 18 and under panel 19 at 20, 21 and at 22, 23 to provide longitudinal openings 24 (see FIGS. 7 and 8). After sleeve 13 is folded upon the scores, under panel 19 is fastened to the underside of central panel or platform 12 as by an adhesive to form sleeve 13 (see FIG. 9) and provide additional support for platform 12.

The lateral extension at the other side of central panel 12 includes panels identical with panels 16, 17, 18, 19 and cuts 20, 21 and 22, 23, which have been referenced 26, 27, 28, 29 and 30, 31 and 32, 33, respectively, for forming sleeve 14 in the manner stated for forming sleeve 13.

The novelty in the present invention lies in the "so called" bridge structure or spreader generally indicated by reference numeral 40. The bridge structure comprises a bridge board or plank 41 and two bridge footings 42, 43 fastened to opposite ends of the bridge board 41. The bridge footings 42, 43 are both geometrically square and the edges 42A, 42B and respective 43A, 43B are positioned at ninety degrees to the longitudinal axis of the bridge board 41 so that, opposite edges 42A, 42B and 43A, 43B (see FIGS. 2 and 5) when positioned in sleeves 13 and 14, respectively, abut side panels 16, 26 and inner upright portion 18, 28 respectively, to spread and suspend platform 12 and prevent platform 12 from tipping.

Bridge structure 40 is adapted to be removably secured in pallet 10. Bridge board 41 passes through longitudinal openings 24, 34 with footings 42, 43 located in sleeves 13, 14 respectively.

Two bridge structures or spreaders 40 are required for each pallet 10. One for each end of platform 12 with the bridge board 41 supporting opposite ends of platform 12 and with footings 42, 43 located at opposite ends of sleeves 13, 14 respectively. The edges 42A, 43A abutting side panels 16, 26, respectively, suspend platform 12 longitudinally to strengthen platform 12 through suspension and tension to increase the load carrying capacity of platform 12. The suspension can be seen in FIGS. 1, 5 and 6 between the outer sides of under panels 19, 29 and above plank 41.

To further increase the load carrying capacity of platform 12, two stringers, generally indicated by reference numerals 45, FIGS. 3, 4 and 6) may be fabricated from fiberboard, scored and folded into a "V" shape with the base of the "V" indicated at 47, 47A, and the top opposite edges of the "V" at 48, 48A, and 49, 49A, respectively.

Stringers 45, 46 are removably secured in sleeves 13, 14, respectively, with the bases 47, 47A supported upon bottom face panels 17, 27, respectively, and with edges 48, 49 and 48A, 49A abutting the underside of platform 12, respectively. Stringer 45 lies between bridge footings 42 located at opposite ends of Sleeve 13. In like manner, stringer 46 lies between bridge footings 43 located at opposite ends of sleeve 14.

Figure 11:
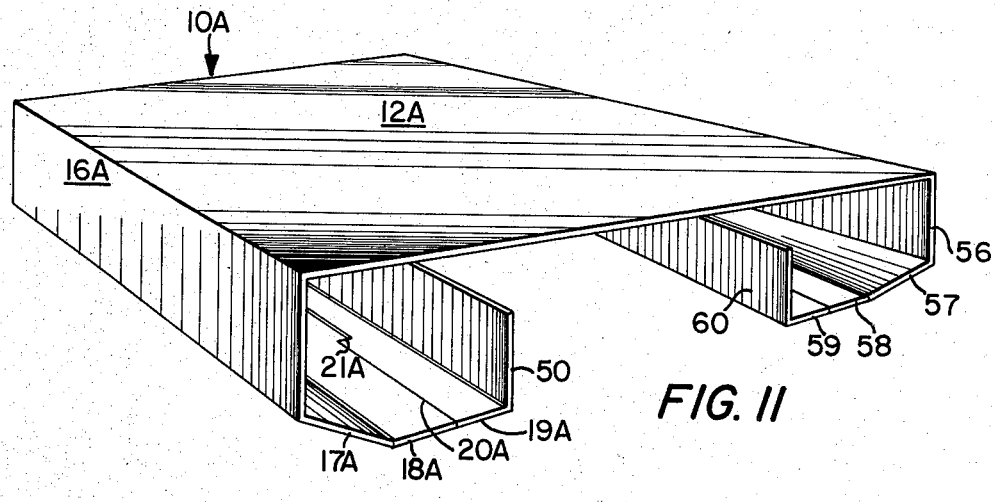
FIG. 11 is a perspective view showing the initial folds made to the body.
Figure 12:
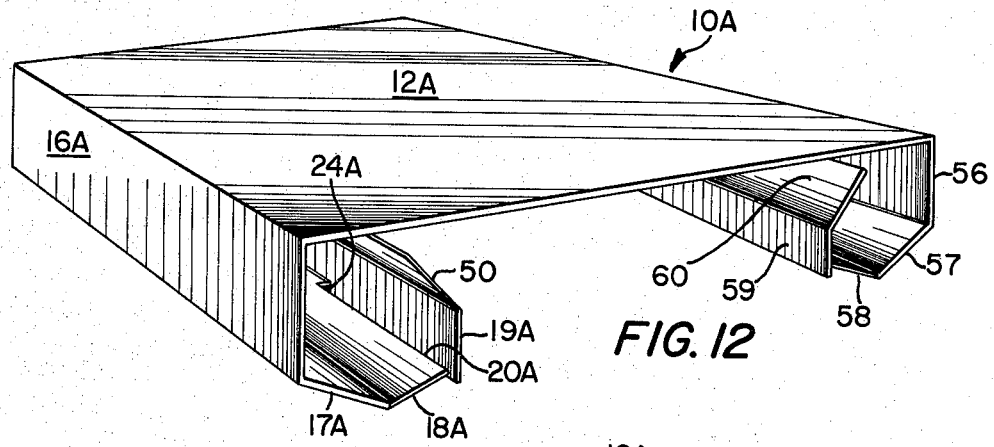
FIG. 12 is similar to FIG. 11 showing the progressive folding of the folds shown in FIG. 11.
Figure 13:
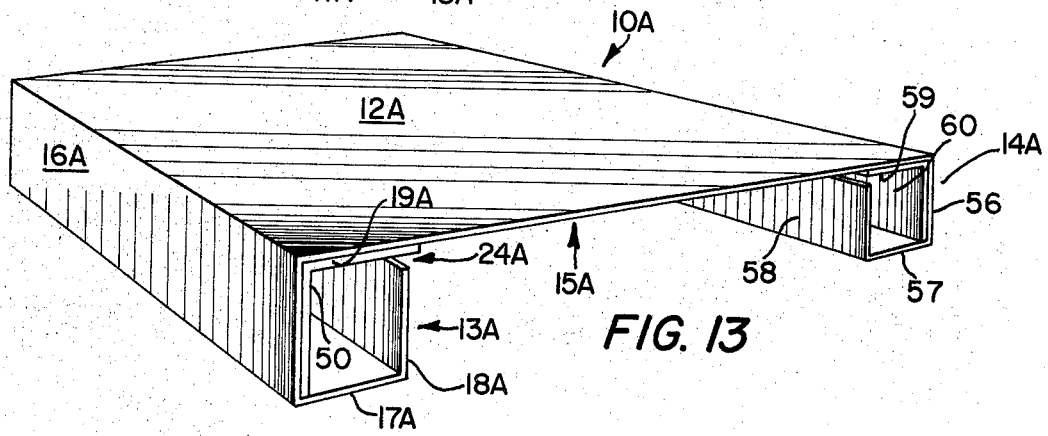
FIG. 13 is a perspective view showing the completed folding of the body of the pallet.
Figure 15:
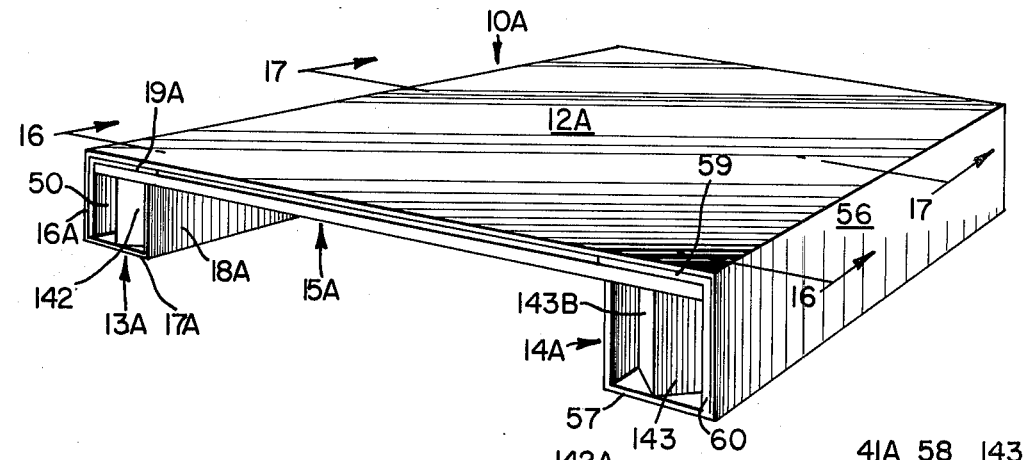
FIG. 15 is a perspective view of the new and improved modified form of pallet.
Figure 14:
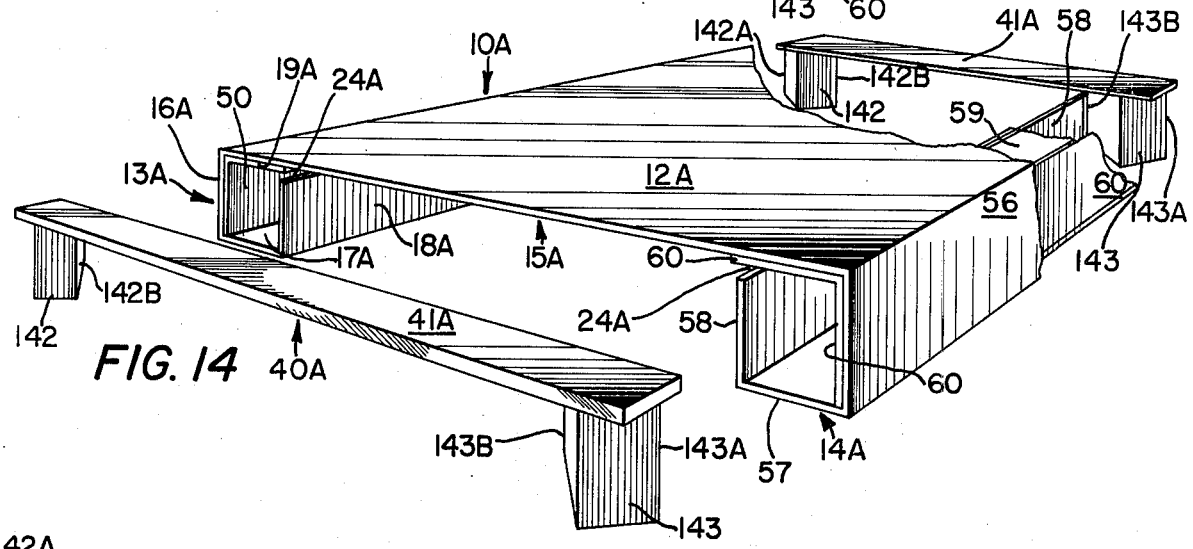
FIG. 14 is an exploded perspective view showing the body in folded condition and the member which reinforces the unfolded portion of the body.
Figure 16:
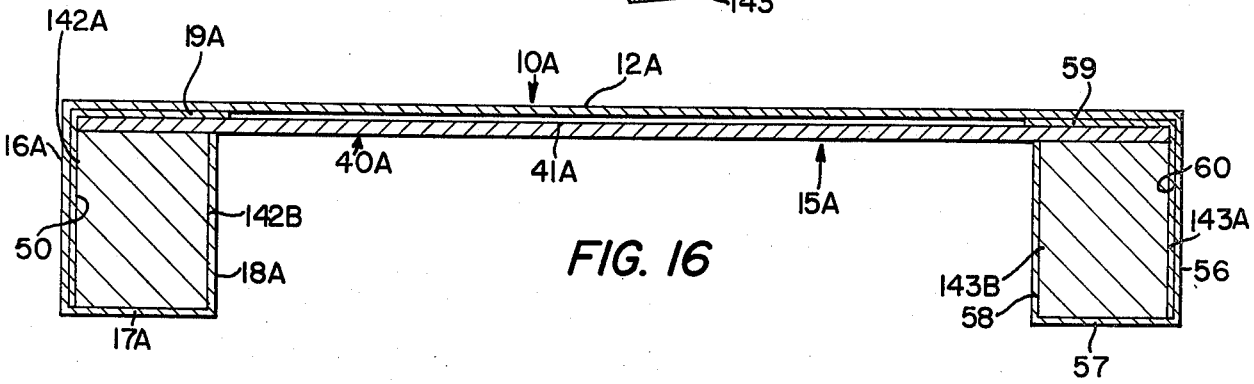
FIG. 16 is a cross sectional view taken on line 16—16 of FIG. 15.
Figure 17:
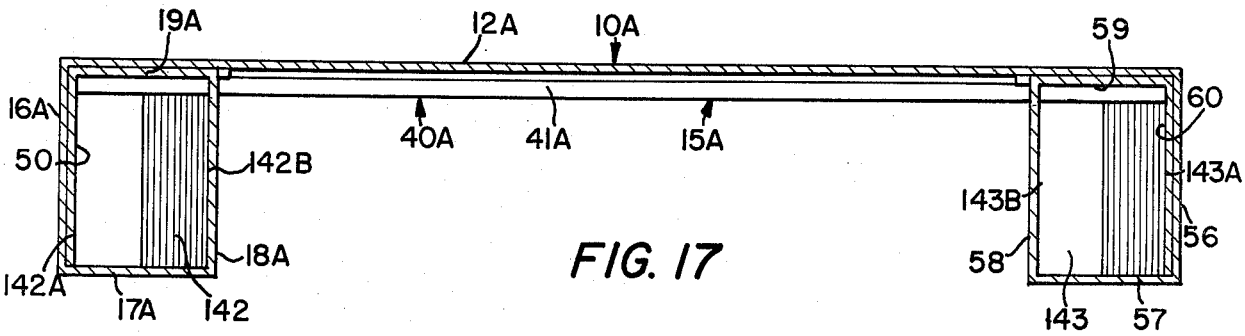
FIG. 17 is a cross-sectional view taken on line 17—17 of FIG. 15.

Reference is now made to FIGS. 10, 11, 12, 13, 14, 15, 16 and 17 wherein is shown a modified form of pallet or portable materials handling accessory adapted for use in lift truck operations, generally indicated by reference character 10A, constructed from a sheet of fiberboard and provided with a spreader or bridge like device 40A.

The modified form comprises a central panel 12A, adapted to form the elevated platform having lateral extensions which are suitably scored to permit them to be folded under the platform 12A to provide two oppositely located sleeves 13A, 14A extending in parallel relation longitudinally of the structure and defining therebetween a passageway 15A for lift truck fork entry.

Central Panel 12A is provided on each side with a lateral extension. The lateral extension on one side is divided by scores into a side panel 16A, a bottom face panel 17A, an inner upright portion 18A, an under panel 19A and a lock panel 50, forming sleeve 13A. A cut is made along the boundary between inner upright portion 18A and under panel 19A at 20A, 21A and at 22A, 23A to provide longitudinal openings 24A. After sleeve 13A is folded upon the scores (as seen in FIGS. 10, 11, 12 and 13), lock panel 50 lies against side panel 16A (see FIGS. 13, 15, 16 and 17), thereby adding support to platform 12A along one exterior side wall 16A and support at the corner and inward of the corner along the side of the central panel 12A.

The lateral extension at the other side of central panel 12A includes panels identical with panels 16A, 17A, 18A, 19A and 50 and cuts 20A, 21A and 22A, 23A which have been referenced 56, 57, 58, 59 and 60 and cuts 70, 71 and 72, 73, forming sleeve 14A in the manner stated for forming sleeve 13A. The side wall of Sleeve 14A is doubled to add support thereto and to platform 12A in the manner of sleeve 13A previously stated.

A spreader or bridge structure, generally indicated by reference numeral 40A, comprises a bridge board or plank 41A and two bridge footings 142, 143 fastened to opposite ends of the bridge board 41A. The bridge footings 142, 143 are preferably but not exclusively square having edges 142A, 142B and 143A, 143B, respectively, positioned at ninety degrees to the longitudinal axis of the bridge board 41A so that opposite edges 142A, 142B and 143A, 143B when positioned in sleeves 13A, 14A respectively, abut side panels 16A, 60 and inner upright portion 18A, 58, respectively, to spread and suspend platform 12A and prevent platform 12A from tipping. The suspension can be seen in FIGS. 15, 16 and 17 between the outer sides of under panel 19A and 59 and above plank 41A.

Bridge structure 40 is adapted to be removably secured in Pallet 10A. Bridge board 41A passes through longitudinal openings 24A, 34A with footings 142, 143 located in sleeves 13A, 14A, respectively.

Two bridge structures or spreaders 40A are required for each pallet 10A as previously stated in describing the structure for Pallet 10.

Stringers 45, 46 may be used in the modified form of pallet 12A but the reinforcement of the side wall through the abutting of side panel 16A and lock panel 50 which also strengthens the corner at central panel 12A and side panel 16A, generally makes such addition to sleeve 13A unnecessary. Platform 12A is also supported by lock panel 50 along its longitudinal sides (see FIG. 13). It will be observed that footings 142, 143 when located in sleeves 13A, 14A push lock panel 50 and 60 against side panels 16A and 56, respectively, to secure sleeves 13A, 14A in position and platform 12A in suspension.

Having shown and described preferred embodiments of the present invention by way of example, it should be realized that structural changes could be made and other examples given without departing from either the spirit or scope of this invention.

What I claim is:

1. A portable materials handling accessory adapted for use in lift truck operations consisting essentially of a single fiberboard sheet having a central panel forming an elevated platform and having side portions, integral with said central panel, folded under said central panel to provide two hollow sleeves extending beneath and on opposite sides of said platform and defining a passageway for a lift truck fork entry beneath said platform, bridge structure means including a bridge board, longitudinal openings in said two hollow sleeves adapted to receive said bridge board, said bridge board supporting one end of said platform, and provided with two footings, one attached to each end of said bridge board and located respectively, one in each sleeve to place said platform in stress, and a second bridge structure means including a bridge board, second longitudinal openings in said two hollow sleeves adapted to receive said second bridge board, said second bridge board supporting the opposite end of said platform, said second bridge board having two footings, one attached to each end thereof, and located, respectively, one in each sleeve to place said platform in suspension and under stress.

2. A portable materials handling accessory as claimed in claim 1 wherein two "V" shaped stringers located, respectively, one in each hollow sleeve, support the opposite sides of said platform.

3. A portable materials handling accessory adapted for use in lift truck operations comprising a sheet of fiberboard, having a central panel adapted to form an elevated platform and a plurality of longitudinally spaced side portions integral with said central panel extending laterally from both sides of said central panel, each of said side portions having a series of laterally spaced scores to divide said side portions into a side panel, a bottom face panel, an inner upright portion and an under panel, two opposite and parallel end cuts along the boundary between said inner upright portion and under panel to provide two longitudinal openings, whereby said side portions may be folded along said scores under said central panel with surfaces of said inner upright portions in face to face relation and with said longitudinal openings in face to face relation to provide two hollow longitudinally spaced sleeves extending longitudinally beneath said central panel, with oppositely located spaced apart longitudinal openings in the opposite end portions of each sleeve, and means fastening each under panel to the underside of said platform to reinforce said platform, two bridge structures each comprising a bridge board, two footings, one for each end of said bridge board, means fastening said two footings to said bridge board, each of said two bridge structures being placed beneath opposite ends of said platform, with each bridge board located in one of said two longitudinal openings in face to face relation and with the footings on opposite ends of the bridge board located in one of the two hollow longitudinally spaced sleeves, respectively, said bridge board supporting said platform and said footings abutting, respectively, the side panel in each sleeve to stress said platform and hold said platform in suspension.

4. A portable materials handling accessory as claimed in claim 3 wherein said two footings comprise geometrically square configurations having opposite edges aligned along the longitudinal axis of said bridge board, opposite edges abutting said side panel and inner upright of said hollow longitudinally spaced sleeves, respectively, to prevent said platform from tipping.

* * * * *